US011629595B2

(12) United States Patent
Webre, Jr.

(10) Patent No.: US 11,629,595 B2
(45) Date of Patent: Apr. 18, 2023

(54) METHOD FOR EXPANSION OF MATURE BRINE WELLS IN SALT DOMES

(71) Applicant: Lloyd Webre, Jr., Houston, TX (US)

(72) Inventor: Lloyd Webre, Jr., Houston, TX (US)

(73) Assignee: Lloyd Webre, Jr., Houston, TX (US)

( * ) Notice: Subject to any disclaimer, the term of this patent is extended or adjusted under 35 U.S.C. 154(b) by 77 days.

(21) Appl. No.: 17/023,606

(22) Filed: Sep. 17, 2020

(65) Prior Publication Data

US 2022/0082018 A1 Mar. 17, 2022

(51) Int. Cl.

| | |
|---|---|
| ***E21C 41/20*** | (2006.01) |
| ***E21B 7/26*** | (2006.01) |
| ***E21B 17/10*** | (2006.01) |
| ***E21B 47/04*** | (2012.01) |
| ***E21B 43/28*** | (2006.01) |
| ***E21B 33/12*** | (2006.01) |

(52) U.S. Cl.
CPC ..... *E21C 41/20* (2013.01); *E21B 7/26* (2013.01); *E21B 17/1078* (2013.01); *E21B 33/12* (2013.01); *E21B 43/28* (2013.01); *E21B 47/04* (2013.01)

(58) Field of Classification Search
CPC ..... E21C 41/00; E21B 7/20; E21B 43/28
See application file for complete search history.

(56) References Cited

U.S. PATENT DOCUMENTS 9,322,253 B2 * 4/2016 Barry ..... E21B 43/385

* cited by examiner

*Primary Examiner* — Robert E Fuller
(74) *Attorney, Agent, or Firm* — Hammer & Associates, P.C.

(57) ABSTRACT

A method for expanding a mature brine well cavern includes determining the position and depth of an insoluble deposit and the volume and depth of a salt formation in the well. An outer drill casing is used to penetrate the soluble deposit and the salt underneath the insoluble deposit. The method further includes drilling continuously through the insoluble deposit and drilling into the salt formation.

7 Claims, 4 Drawing Sheets

METHOD FOR EXPANSION OF MATURE BRINE WELLS IN SALT DOMES

FIELD OF THE INVENTION

The invention provides a method for extracting salt from pre-existing, mature brine well caverns which have been deemed unsuitable for further solution mining due to depth and width limitations.

BACKGROUND OF THE INVENTION

A salt dome is a mass of salt that has intruded upwards into overlying sediments. Where conditions allow, salt domes can rise thousands of feet above the layer of salt from which they began growing, ascending from depths of between 5 and 6 miles (or more) below the ground surface. In the United States, salt domes are found primarily in the Gulf Coast Embayment. For many years, brine mining, or solution mining, was normally limited to about 6000 feet below ground level because of the abundance of shallow accessible dome salt and hydraulic limitations. Moreover, as the salt is removed during brine mining or solution mining operations, a deposit of insoluble materials and loose sand ("insoluble deposit") is deposited on the bottom of the cavern floor where salt has been removed.

SUMMARY OF THE INVENTION

In one embodiment, the invention provides a method for expanding an existing brine well cavern in a salt dome wherein the brine well is comprised of existing cemented casings into the cavern, a cavern, cavern roof, and an insoluble deposit filling the bottom portion of the salt cavern. The method for expansion is comprised of a drilling operation incorporating the steps of (1) removing existing seal fluids followed by removing existing hanging strings from the mature brine well, (2) determining from past and present sonars the top of, depth of, and volume of the insoluble deposit as it relates to the original total depth of the mature brine well cavern (3) drilling casing continuously through the insoluble deposit into a portion of the salt dome which underlies the mature brine well; (4) providing a rotating drill casing with a drillable drill bit and sufficient length to penetrate the insoluble deposit and penetrate into the salt under the mature brine well cavern; (5) providing the rotating drill casing string with seal packer(s) to be placed in the newly drilled salt; (6) replenishing seal fluid in the mature brine well cavern through drill casing and then setting the packers; (7) passing a standard drill bit on a second drill string through the drill casing to the bottom end of the drill casing; (8) drilling through the drillable drill bit into the lower salt formation; (9) drilling into the salt formation to a pre-determined total depth ("TD"); and (10) mining the salt at the TD to form a lower salt cavern. Additional embodiments are described herein.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

The inventive method has the ability to expand a mature brine well without changing the existing cavern width or spacing between existing caverns. The inventive method assumes that the cavern is hydraulically sound, and that a salt formation below an insoluble deposit in the mature brine well is available for mining.

Determination of the suitability of an existing brine well for the inventive method may be made by any procedure, suitable for determining the relevant factors. Such procedure may be, for example, early sonar examinations of the well. Preferably, the procedure will provide, at a minimum, the depth of and thickness of and volume of the insoluble deposit and the existence of and shape of the early mined salt formation containing the insoluble deposit. Based on such data, the length of drill casing needed to penetrate and completely pass through the insoluble deposit and into the salt formation may be determined. In some embodiments, the drill casing with in line seal packers is completely constructed on the surface prior to drilling.

Without limiting the application of the inventive method, a typical mature brine well cavern suitable for use with the inventive method may have a standard teardrop type shape, a cavern of about 300 feet in diameter with a diesel roof pad. A typical well may have a 30 inch diameter into the surface casing with a 20 inch diameter interior casing cemented within the surface casing to about 3000 feet surface/salt depth depending on the dome and 16 inch borehole drilled to a salt/surface depth of about 6000 feet original TD. Solution mining of such a mature brine well may further result in about 600 feet or more of insoluble deposit, which resides in the bottom of the cavern.

Figure 1:
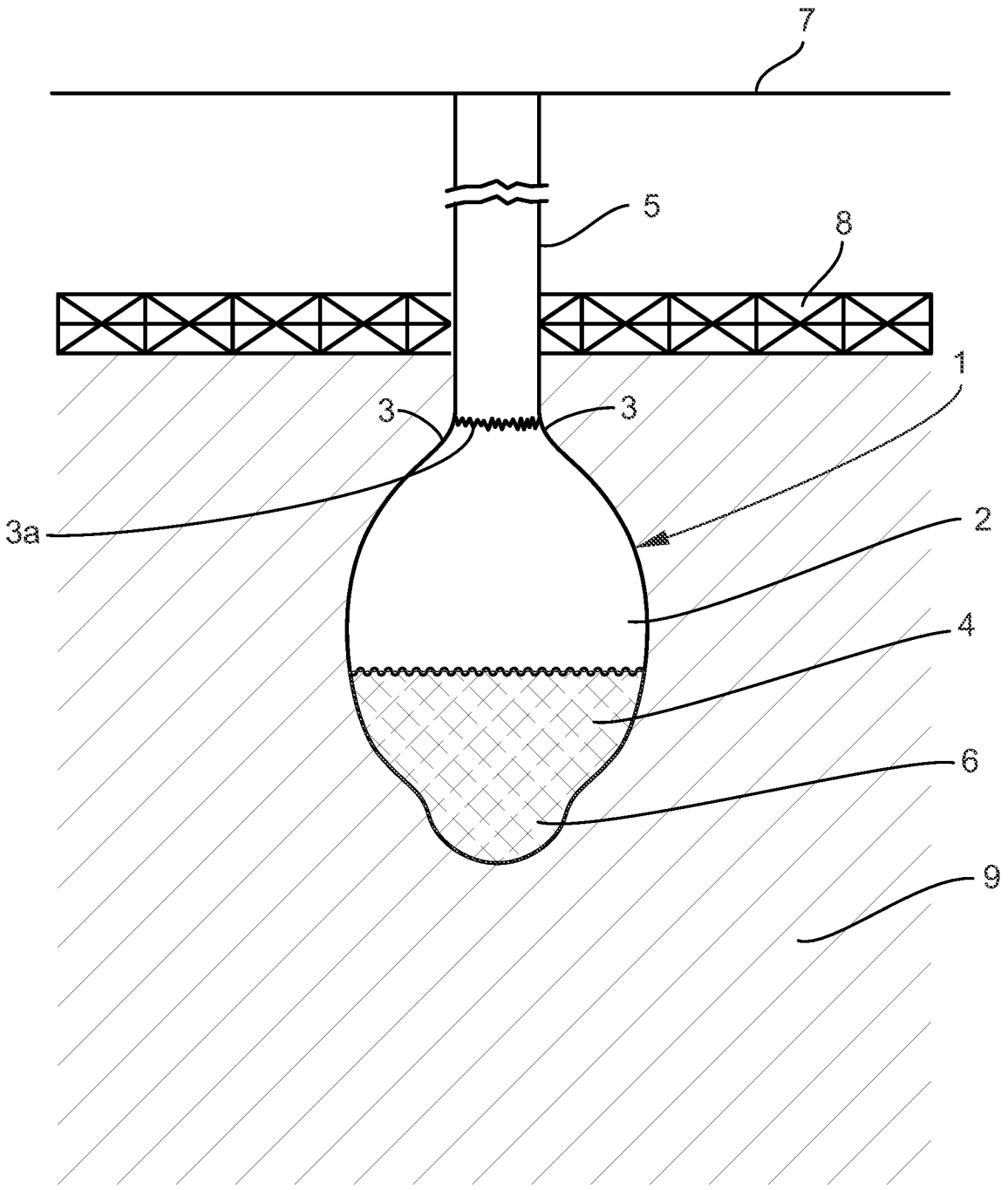
FIG. 1 is a schematic cross sectional view of an existing mature brine well in a salt dome formation prior to operation of the inventive method.

Referring to FIG. 1, a mature brine well suitable for use with the inventive method is schematically illustrated. The mature brine well 1 is located beneath the ground surface 7 and caprock strata 8. The subsurface formation 7*a* extends between the ground surface 7 and caprock strata 8. Below the caprock strata 8 is a salt dome 9 which extends upwardly from a deeper salt formation. The mature brine well 1 which has been previously drilled and exploited is comprised of a cavern 2, cavern roof 3, and an insoluble deposit 4. The mature brine well 1 further includes a seal fluid 3*a* at the level of the cavern roof 3. Connecting the cavern 2 to the ground surface 7 is an existing outer surface casing 5, previously placed for the prior solution mining of the salt dome 9. In some embodiments, there may be up to four casings in addition to the surface casing 5. The mature brine well 1 may further include a sump 6 for holding all or part of the insoluble deposit 4. The sump 6 may not be present in all suitable mature brine wells but is typically formed in conventional solution mining processes in which the insoluble materials are left deposited in the cavern 2. Underlying the mature brine well 1 the salt formation 9 continues downwardly and is available for further mining and exploitation. As shown in FIG. 1, previously used hanging strings used to create the mature brine well 1 have been removed. As can be seen in FIG. 1, additional salt reserves exist in the salt dome 9 residing below the mature brine well 1.

Figure 2:
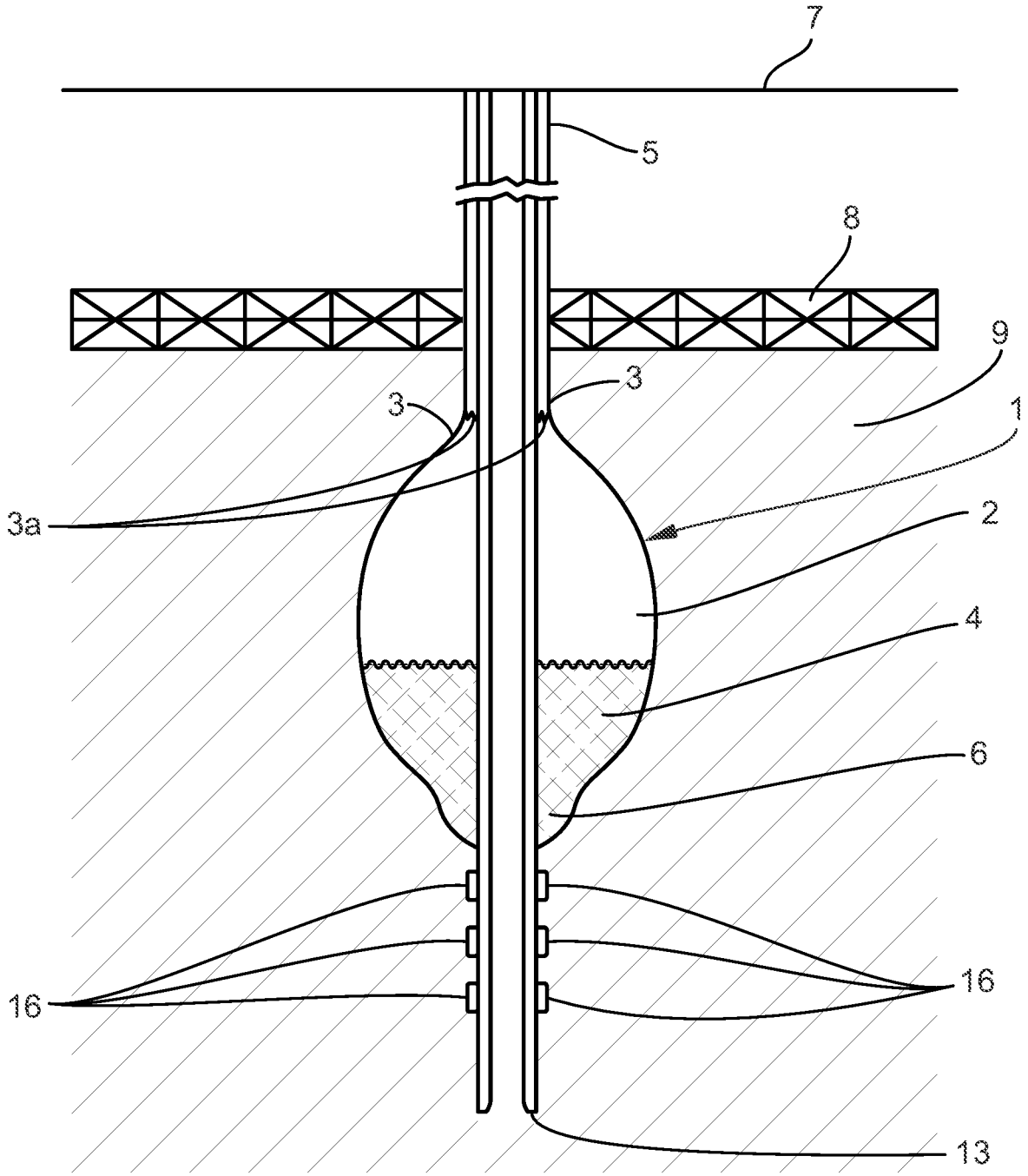
FIG. 2 is a schematic cross sectional view of an existing mature brine well in a salt dome formation following operation of an embodiment of the inventive method using a drillable bit to penetrate the insolubles and into the salt formation below the existing brine well cavern for a few hundred feet and setting casing using hydraulic packers.
Figure 3:
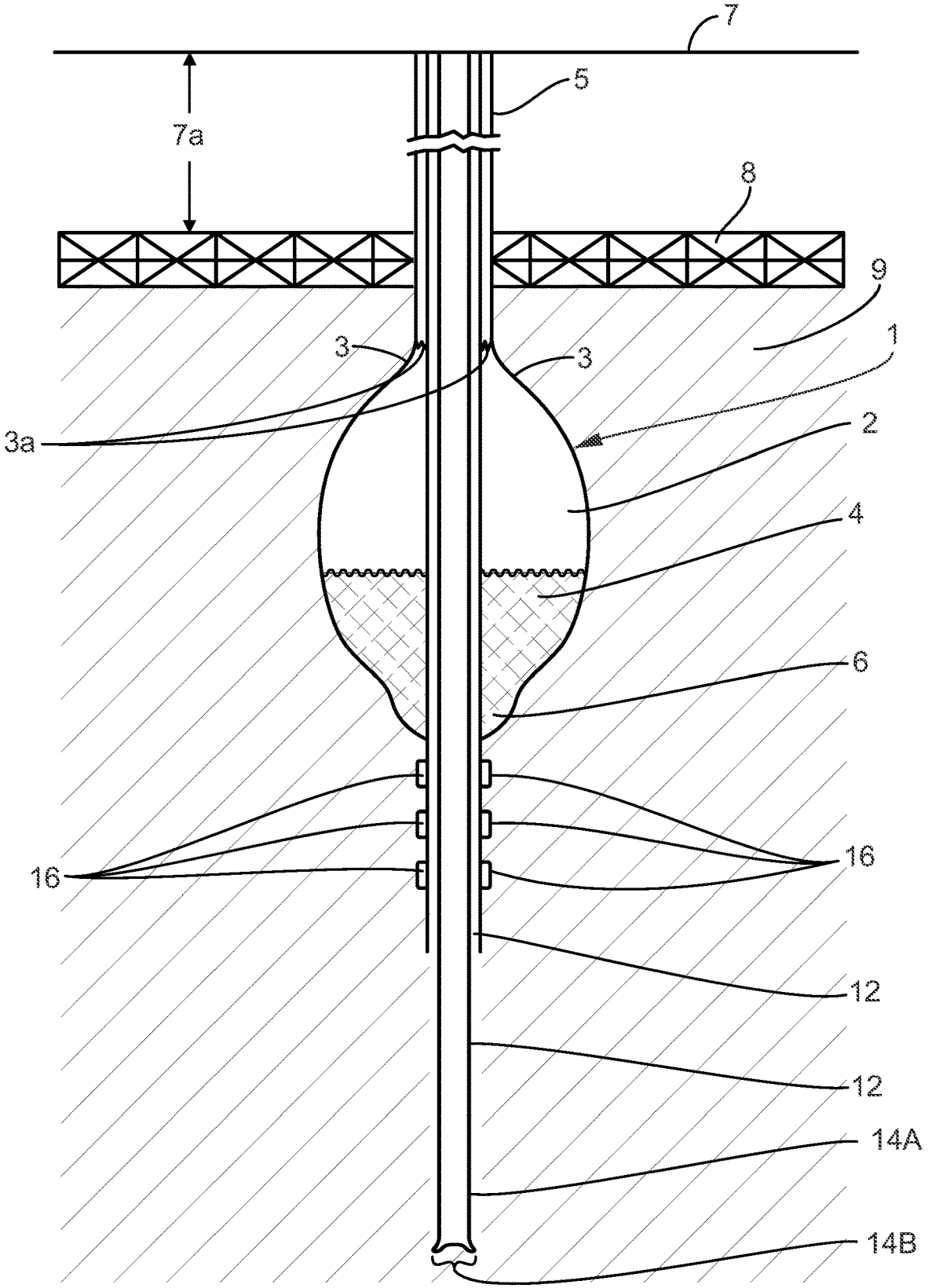
FIG. 3 is a schematic cross sectional view of an existing mature brine which has been drilled through using a drillable drill bit and subsequently drilled to total depth (TD) in the salt.

Referring to FIGS. 2 and 3, the inventive method uses a rig for removing existing seal fluids followed by removing all the hanging strings from the mature brine well 1, including pre-existing casing wash string. The pre-existing casing may be evaluated for re-use in some embodiments. Alternatively, all or part of the pre-existing casing may be replaced with new casing. In one embodiment, at least 1000 feet of the pre-existing casing is replaced with smooth joint (i.e., collarless) string. For drilling insoluble materials and about 150 feet of salt underlying the insoluble materials in the mature brine well, particularly preferred is outer drill string casing 12 designed with strength for rotational speed of at least about 30 rpm (rotations per minute).

In the inventive method, the outer drill string casing 12, either re-used or new outer drill casing, terminates with a drillable drill bit. 13. Such drillable drill bits 13, also referred to as drilling with casing systems, are known and disclosed, for example, in U.S. Pat. Nos. 7,096,982 and 7,083,005, the disclosures of which are incorporated herein by reference. Any such casing drillable drill bits 13, which may be drilled through using standard drill bits 14B, may be used in the inventive method.

In a particular embodiment of the inventive method, the casing 12 with the drillable drill bit 13 attached thereto is used to drill, without interruption, through the insoluble deposit 4 (and insoluble filled sump 6, if present) and into the salt formation 9 underlying the mature brine well 1. In a preferred embodiment, the casing 12 with drillable drill bit 13 drills into at least about 150 feet of the salt formation 9. This operation is referred to as an initial drilling operation.

In some embodiments of the inventive method, the drill string casing 12 is connected to the salt formation 9 using multiple resettable packers 16 mounted in the casing above the drillable drill bit 13. Particularly preferred packers are inflatable packers. The initial drilling operation is finished when the packers 16 are set at which time, the casing is semi-permanent. In some embodiments, diesel seal fluid is injected into the hole prior to placement of the packers.

After setting drill string packers 16, sealing the casing to the salt formation 9, a standard drill string, which comprises a standard drill string 14A and a standard drill bit 14B, is assembled and lowered through the drill string casing 12 to be used in a second drilling operation. See FIGS. 3 and 4. The second drilling operation is used to drill through the drillable bit 13 and into the salt formation 9 to a pre-determined TD. Once reaching the TD, the standard drill string 14B is removed to allow standard salt mining strings, such as wash casing and production casing, to be installed to the TD. Such casings may have, for examples, diameters of 1¾, 9⅝, 4½ and 5 inches. Using known solution mining techniques, a new lower brine well cavern 17 below the mature brine well 1 is developed. The pre-determined TD of the new brine well 17 is a function of salt temperature and its effect on salt well bore closure and desired new production brine concentration. Solution mining models will be used to determine seal levels, injection levels, wash volumes, and return brine saturation levels in conjunction with salt being safely mined upwards.

In a specific embodiment, the inventive method produces a new brine well 17 having a bottom maximum diameter of about 300 feet wide (similar to the cavern 2) and a height of about 1500 feet. Such exemplary dimensions would provide sufficient volume from new salt removal to allow displacement of the insoluble deposit from the existing brine well as well as insoluble materials formed during the mining of the new lower salt cavern. The total depth of the new lower salt cavern may range, in some embodiments, from 6000 to 8350 feet. All values and subranges from 6000 to 8350 feet are included and disclosed herein.

Figure 4:
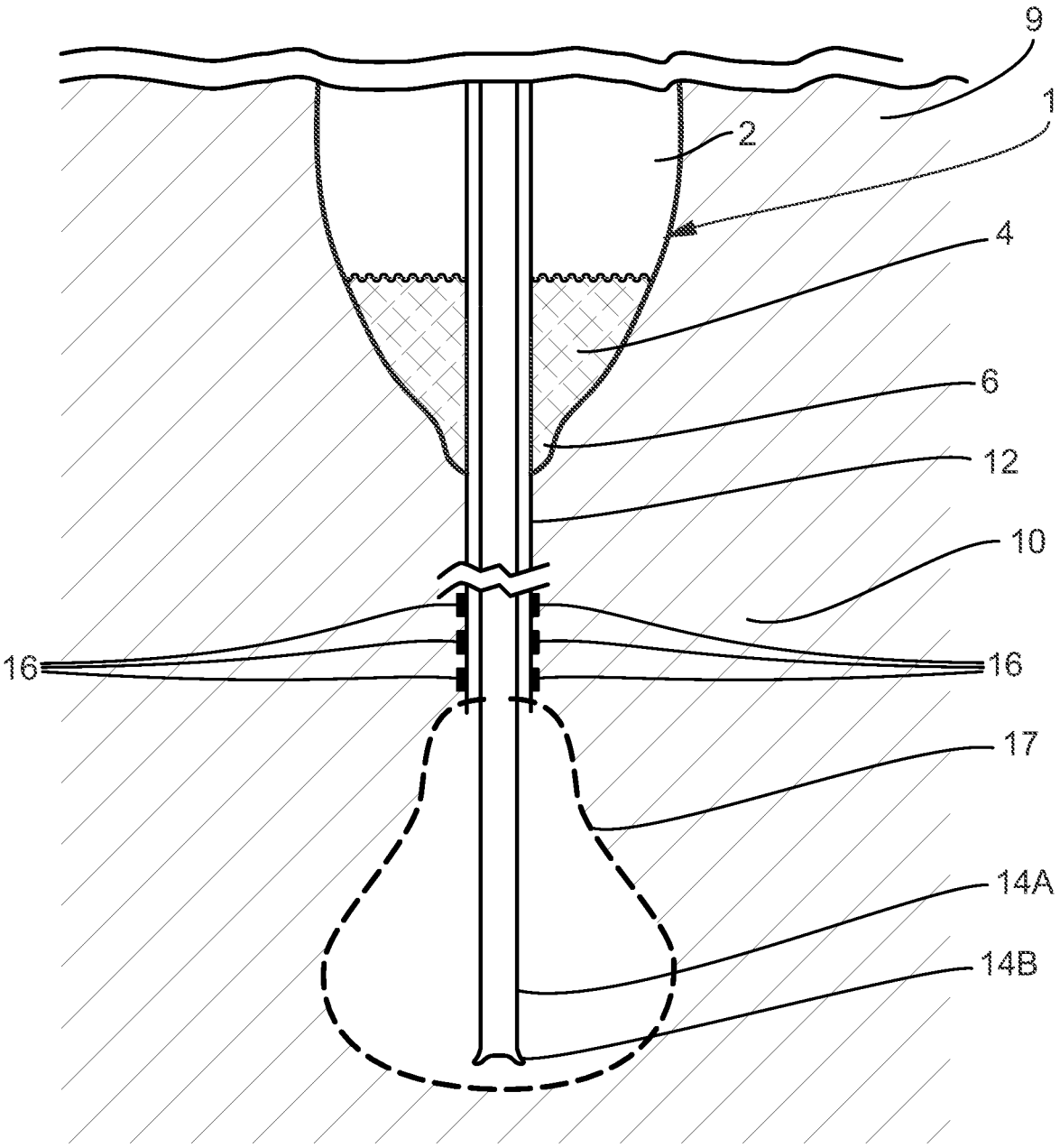
FIG. 4 is a schematic cross sectional view of a bottom portion of a mature brine well and a new brine well under the mature bine well according to an embodiment of the inventive method.

Referring to FIG. 4, a schematic showing the outline of a new lower brine well cavern 17 (shown by dashed lines) in the salt formation lying below the pre-existing mature brine well cavern 1. As shown in FIG. 4, the standard drill bit 14B drills to near a proposed total Depth (TD) of the new lower brine well cavern 17. Subsequently, the standard drill bit 14B is removed the standard brine well mining equipment is lowered to begin brine well production.

What is claimed is:

1. A method for mining a salt dome under the Earth's surface wherein the salt dome includes a mature brine well including an existing casing extending from the surface into an upper cavern, an insoluble deposit at a bottom of the upper cavern, and optionally, a sump for holding the insoluble deposit in whole or in part, the method comprising an initial drilling operation comprising the steps of:

(1) removing existing seal fluids followed by removing existing hanging strings from the mature brine well;
(2) determining from past and present sonars the top of, depth of, and volume of the insoluble deposit as it relates to the original total depth of the upper cavern;
(3) providing a drill casing with a drillable drill bit and sufficient length to penetrate the insoluble deposit and penetrate into a portion of the salt dome which underlies the mature brine well;
(4) rotating the casing to drill through the insoluble deposit into the portion of the salt dome which underlies the mature brine well;
(5) providing the drill casing string with seal packer(s) to be placed in the portion of the salt dome which underlies the mature brine well;
(6) replenishing seal fluid in the upper cavern through the drill casing and then setting the packers;
(7) passing a drill bit on a second drill string through the drill casing to a bottom end of the drill casing;
(8) drilling through the drillable drill bit into the portion of the salt dome which underlies the mature brine well;
(9) drilling into the portion of the salt dome which underlies the mature brine well to a pre-determined total depth ("TD"); and
(10) mining the salt at the TD to form a lower salt cavern.

2. The method for mining a salt dome according to claim 1, wherein the packers are resettable packers.

3. The method for mining a salt dome according to claim 2, wherein the drill string casing is a smooth joint string.

4. The method for mining a salt dome according to claim 1, wherein the drill bit is mounted with centralizing stabilizers.

5. The method for mining a salt dome according to claim 1, wherein the outer drill string casing is designed with strength for rotational speed of at least about 30 rpm (rotations per minute).

6. The method for mining a salt dome according to claim 1, wherein the total depth is from 6000 to 8350 feet.

7. The method for expanding an existing brine well in a salt dome according to claim 6, wherein the total depth is about 8,350 feet.

* * * * *